US011599048B2

(12) United States Patent
Ikeno

(10) Patent No.: US 11,599,048 B2
(45) Date of Patent: Mar. 7, 2023

(54) FIXING DEVICE FOR FIXING TONER TO SHEET

(71) Applicant: BROTHER KOGYO KABUSHIKI KAISHA, Nagoya (JP)

(72) Inventor: Yuichi Ikeno, Maibara (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/541,435

(22) Filed: Dec. 3, 2021

(65) Prior Publication Data

US 2022/0179346 A1 Jun. 9, 2022

(30) Foreign Application Priority Data

Dec. 4, 2020 (JP) ..... JP2020-202301
Dec. 4, 2020 (JP) ..... JP2020-202302

(51) Int. Cl.
*G03G 15/20* (2006.01)

(52) U.S. Cl.
CPC ..... *G03G 15/2053* (2013.01); *G03G 15/2017* (2013.01); *G03G 15/2057* (2013.01); *G03G 2215/2003* (2013.01)

(58) Field of Classification Search
CPC ..... G03G 15/2017; G03G 15/2053; G03G 15/2057; G03G 2215/2003; G03G 2215/2035
See application file for complete search history.

(56) References Cited

U.S. PATENT DOCUMENTS

| | | | | |
|---|---|---|---|---|
| 2014/0186078 | A1 | 7/2014 | Imaizumi et al. | |
| 2015/0139707 | A1 | 5/2015 | Suzumi et al. | |
| 2015/0227091 | A1 | 8/2015 | Ando et al. | |
| 2017/0102651 | A1 | 4/2017 | Tanaka et al. | |
| 2019/0004459 | A1* | 1/2019 | Sekiyama | G03G 15/2053 |
| 2019/0113868 | A1* | 4/2019 | Akizuki | G03G 15/2064 |
| 2019/0361379 | A1* | 11/2019 | Koyama | G03G 15/206 |

FOREIGN PATENT DOCUMENTS

| | | | |
|---|---|---|---|
| JP | 11-84919 | A | 3/1999 |
| JP | 2014-123100 | A | 7/2014 |
| JP | 2014-238560 | A | 12/2014 |
| JP | 2015-40888 | A | 3/2015 |
| JP | 2015-99327 | A | 5/2015 |
| JP | 2017-72780 | A | 4/2017 |
| JP | 2017-111392 | A | 6/2017 |
| JP | 2018-54898 | A | 4/2018 |

* cited by examiner

*Primary Examiner* — Joseph S Wong
(74) *Attorney, Agent, or Firm* — Merchant & Gould P.C.

(57) ABSTRACT

A fixing device, including: a cylindrical belt; a heater including a base plate and a heating element provided on the base plate; a holder supporting the heater; and a heat-conductive member disposed between the heater and the holder and having a higher heat conductivity than the base plate, wherein the heat-conductive member includes: a contact portion opposed to a region of the base plate between a one-side end and an other-side end of the heating element in the first direction; a first non-contact portion opposed to a region of the base plate in which the one-side end is located, the first side portion being not in contact with the heater, and a second non-contact portion opposed to a region of the base plate in which the other-side end is located, the second side portion being not in contact with the contact portion.

15 Claims, 8 Drawing Sheets

FIXING DEVICE FOR FIXING TONER TO SHEET

CROSS REFERENCE TO RELATED APPLICATION

The present application claims priority to Japanese Patent Applications No. 2020-202301 and No. 2020-202302 both filed on Dec. 4, 2020, the disclosure of which is herein incorporated by reference in its entirety.

BACKGROUND

The present disclosure relates to a fixing device.

A known heating device includes a fixing film and a heater for heating the fixing film. The heating device includes a metal plate that is a highly heat-conductive member disposed between the heater and a heat-insulating support member.

SUMMARY

The metal plate in the known heating device is disposed over an entire region of the heater. In a case where the known heating device is employed in an image forming device, heat generated by the heater is transmitted to outside a region over which a maximum-size sheet passes, the maximum-size sheet being a sheet having a maximum size among sheets printable in the image forming device.

The arrangement may suffer from a decrease in a fixing temperature at opposite end portions in a direction of extension of the heater in the region over which the printable maximum-size sheet passes.

Accordingly, an aspect of the present disclosure is directed to a fixing device capable of preventing or reducing a decrease in the fixing temperature at the opposite end portions of the maximum-size-sheet passing region over which a sheet, which has a maximum size among sheets printable in the image forming device, passes.

In one aspect of the present disclosure, a fixing device includes: a cylindrical belt; a heater to heat the belt, the heater including (a) a base plate and (b) a heating element provided on the base plate, the heating element having a one-side end and an other-side end in a first direction; a holder supporting the heater; and a heat-conductive member disposed between the heater and the holder, the heat-conductive member having a heat conductivity higher than a heat conductivity of the base plate. The heat-conductive member includes: a contact portion that is opposed to a region of the base plate between the one-side end of the heating element and the other-side end of the heating element in the first direction, the contact portion being in contact with the heater; a first non-contact portion that is opposed to a region of the base plate in which the one-side end of the heating element is located, the first non-contact portion being not in contact with the heater, and a second non-contact portion that is opposed to a region of the base plate in which the other-side end of the heating element is located, the second non-contact portion being not in contact with the heater.

In another aspect of the present disclosure, a fixing device includes: a cylindrical belt; a heater to heat the belt, the heater including (a) a base plate and (b) a heating element provided on the base plate, the heating element having a one-side end and an other-side end in a first direction; a holder supporting the heater; and a heat-conductive member disposed between the heater and the holder, the heat-conductive member having a heat conductivity higher than a heat conductivity of the base plate. The heat-conductive member includes: a main portion that is opposed to a region of the base plate between the one-side end of the heating element and the other-side end of the heating element in the first direction; a first opposed portion that is opposed to a region of the base plate in which the one-side end of the heating element is located, the first opposed portion having a cross-sectional area smaller than a cross-sectional area of the main portion, and a second opposed portion that is opposed to a region of the base plate in which the other-side end of the heating element is located, the second opposed portion having a cross-sectional area smaller than the cross-sectional area of the main portion.

BRIEF DESCRIPTION OF THE DRAWINGS

The objects, features, advantages, and technical and industrial significance of the present disclosure will be better understood by reading the following detailed description of embodiments, when considered in connection with the accompanying drawings, in which.

DETAILED DESCRIPTION OF THE EMBODIMENTS

First Embodiment

1. Outline of Image Forming Device 1

Figure 1:
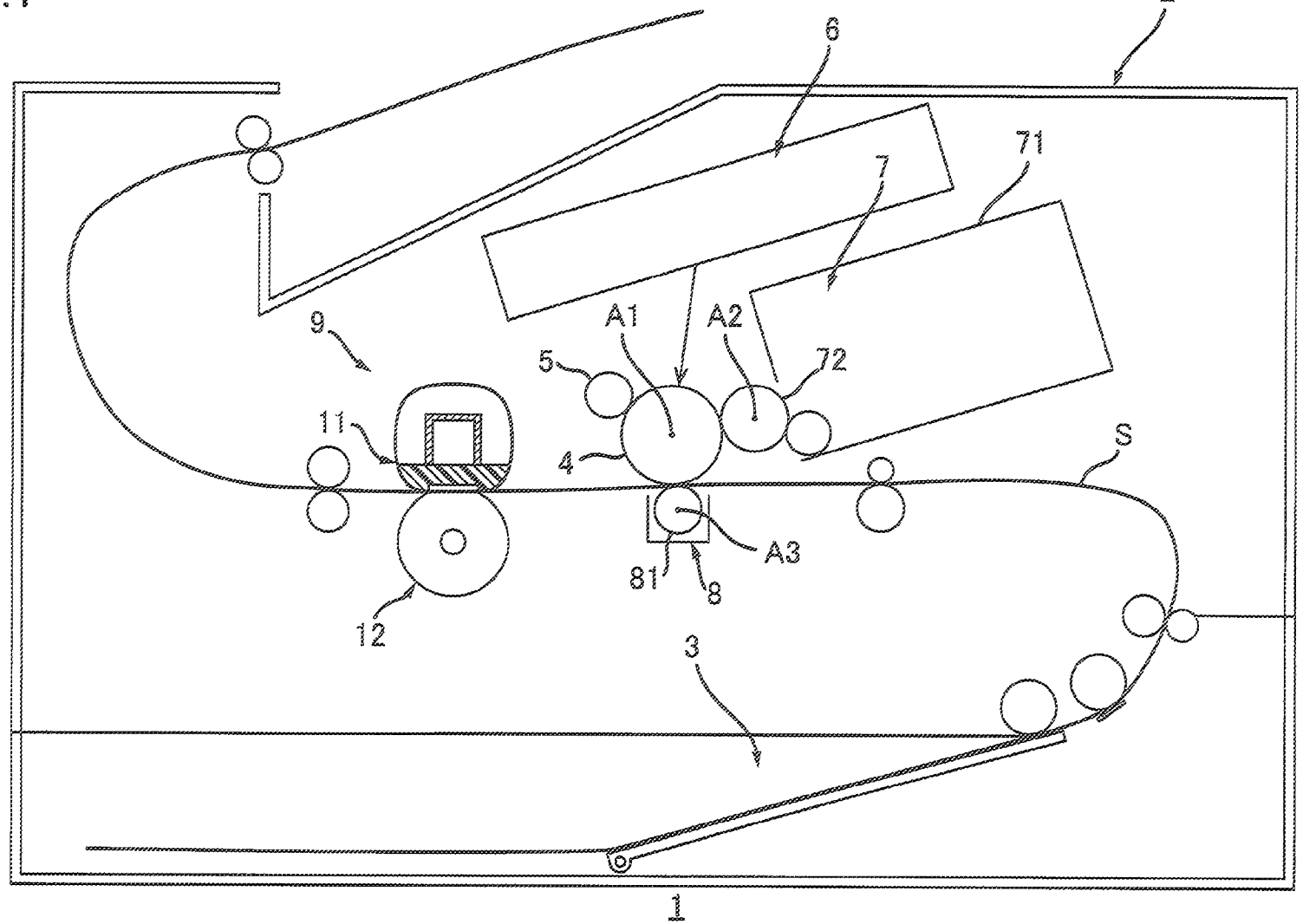
FIG. 1 is a schematic view of an image forming device.

Referring to FIG. 1, there will be explained an outline of an image forming device 1.

The image forming device 1 includes a body housing 2, a sheet storing portion 3, a photoconductor drum 4, a charging device 5, an exposing device 6, a developer device 7, a transfer device 8, and a fixing device 9.

1.1 Body Housing 2

The body housing 2 houses the sheet storing portion 3, the photoconductor drum 4, the charging device 5, the exposing device 6, the developer device 7, the transfer device 8, and the fixing device 9.

1.2 Sheet Storing Portion 3

The sheet storing portion 3 is configured to store sheets S. The sheets S are printing paper, for instance. Each sheet S is conveyed from the sheet storing portion 3 toward the photoconductor drum 4.

1.3 Photoconductor Drum 4

The photoconductor drum 4 is rotatable about a drum axis A1. The drum axis A1 extends in a first direction. The photoconductor drum 4 extends in the first direction.

1.4 Charging Device 5

The charging device 5 is configured to charge the surface of the photoconductor drum 4. The charging device 5 of the present embodiment is a charging roller. The charging device 5 may be a scorotron charger.

1.5 Exposing Device 6

The exposing device 6 is configured to expose the surface of the photoconductor drum 4 charged by the charging device 5. Specifically, the exposing device 6 is a laser scanning unit. The exposing device 6 may be an LED array.

1.6 Developer Device 7

The developer device 7 is configured to supply toner to the photoconductor drum 4. Specifically, the developer device 7 is configured to supply the toner onto the surface of the photoconductor drum 4 exposed by the exposing device 6. The developer device 7 includes a developer housing 71 and a developer roller 72.

1.6.1 Developer Housing 71

The developer housing 71 is configured to store the toner.

1.6.2 Developer Roller 72

The developer roller 72 is configured to supply the toner in the developer housing 71 to the surface of the photoconductor drum 4. In the present embodiment, the developer roller 72 is in contact with the photoconductor drum 4. The developer roller 72 may be spaced apart from the photoconductor drum 4 by a suitable distance. The developer roller 72 is rotatable about a developer axis A2. The developer axis A2 extends in the first direction. The developer roller 72 extends in the first direction.

1.7 Transfer Device 8

The transfer device 8 is configured to transfer the toner on the surface of the photoconductor drum 4 to the sheet S. The transfer device 8 of the present embodiment includes a transfer roller 81. The transfer roller 81 is in contact with the photoconductor drum 4. The transfer roller 81 may be spaced apart from the photoconductor drum 4 by a suitable distance. The uppermost one of the sheets S in the sheet storing portion 3 passes between the photoconductor drum 4 and the transfer roller 81 so as to be conveyed to the fixing device 9. The transfer roller 81 is configured to transfer the toner on the surface of the photoconductor drum 4 to the sheet S passing between the photoconductor drum 4 and the transfer roller 81. The transfer roller 81 is rotatable about a transfer axis A3. The transfer axis A3 extends in the first direction. The transfer roller 81 extends in the first direction. The transfer device 8 may include a transfer belt.

1.8 Fixing Device 9

The fixing device 9 is configured to heat and pressurize the sheet S to which the toner has been transferred, so as to fix the toner to the sheet S. The sheet S that has passed the fixing device 9 is discharged onto an upper surface of the body housing 2.

2. Details of Fixing Device 9

Figure 2:
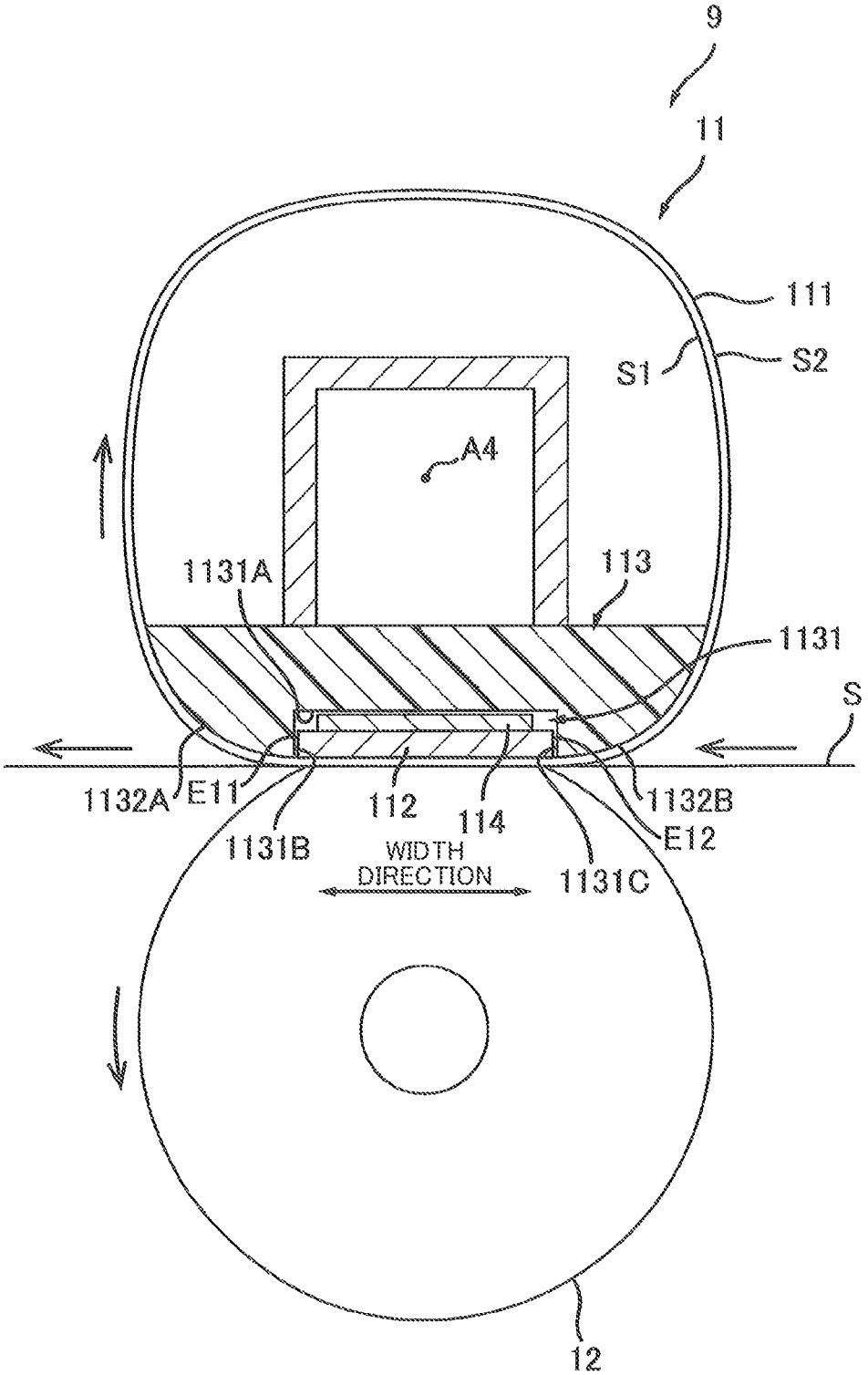
FIG. 2 is a cross-sectional view of a fixing device.
Figure 3:
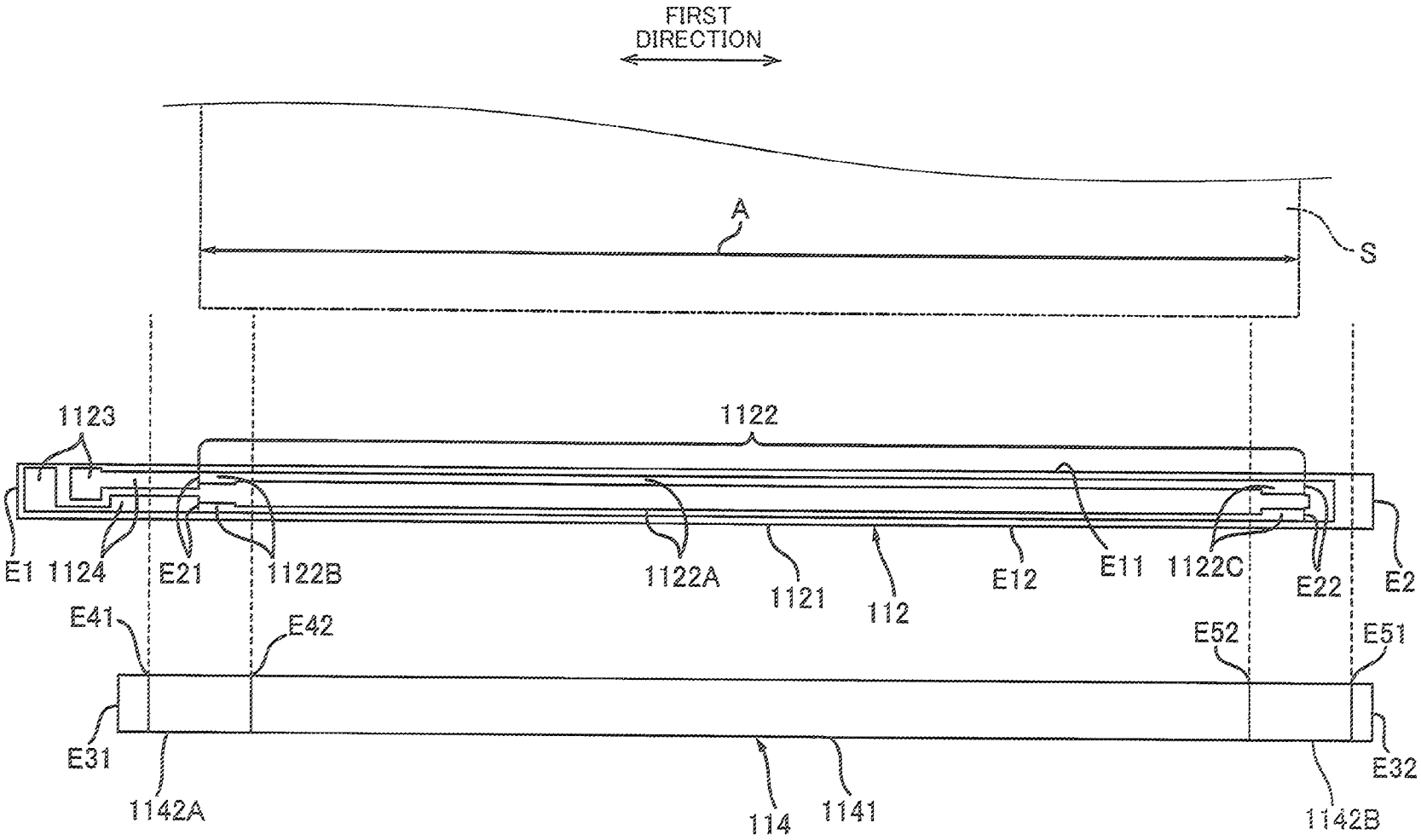
FIG. 3 is an explanatory view illustrating a positional relationship between a heater and a heat-conductive member according to a first embodiment.

Referring to FIGS. 2 and 3, the fixing device 9 will be explained.

As illustrated in FIG. 2, the fixing device 9 includes a heating unit 11 and a pressure roller 12.

2.1 Heating Unit 11

The heating unit 11 is configured to heat the sheet S to which the toner has been transferred. The heating unit 11 includes a belt 111, a heater 112, a holder 113, and a heat-conductive member 114. In other words, the fixing device 9 includes the belt 111, the heater 112, the holder 113, and the heat-conductive member 114.

2.1.1 Belt 111

The belt 111 is configured to heat the sheet S to which the toner has been transferred. The belt 111 is cylindrically shaped. In other words, the belt 111 is an endless belt. The belt 111 extends in the first direction. The belt 111 is rotatable about a rotational axis A4. The rotational axis A4 extends in the first direction. That is, the first direction is parallel to a direction in which the rotational axis A4 of the belt 111 extends. The belt 111 has an inner circumferential surface S1 and an outer circumferential surface S2.

2.1.2 Heater 112

The heater 112 is configured to heat the belt 111. The heater 112 is disposed on an inner side of the belt 111. The heater 112 is in contact with the inner circumferential surface S1 of the belt 111. The heater 112 extends in the first direction. The heater 112 is an elongate flat plate.

As illustrated in FIG. 3, the heater 112 includes a base plate 1121 as one example of a base member, a heating element 1122, terminals 1123, and wires 1124.

2.1.2.1 Base Plate 1121

The base plate 1121 is an elongate flat plate. The base plate 1121 extends in the first direction. The base plate 1121 is formed of a metal such as stainless. The surface of the base plate 1121 is covered with an insulating layer. The base plate 1121 may be formed of a heat-resistant insulating material such as ceramic.

2.1.2.2 Heating Element 1122

The heating element 1122 is provided on the base plate 1121. Specifically, the heating element 1122 is formed by patterning on the insulating layer of the base plate 1121. The heating element 1122 is a resistance heating element formed of an alloy of silver and palladium. The heating element 1122 generates heat by an electric current supplied thereto. The heating element 1122 extends in the first direction. The heating element 1122 is shaped like a plate. The heating element 1122 is located between a one-side end E1 and an other-side end E2 of the heater 112 in the first direction. The heating element 1122 has an one-side end E21 located, in the first direction, at a one-side end portion of a region A over which a maximum-size sheet S passes, the maximum-size sheet S being a sheet having a maximum size among sheets S printable in the image forming device 1. The region A will be hereinafter referred to as "region A" or "maximum-size-sheet passing region A" where appropriate. The heating element 1122 has an other-side end E22 located at an other-side end portion of the region A in the first direction. The heating element 1122 includes a first portion 1122A, a second portion 1122B, and a third portion 1122C.

The first portion 1122A is a middle portion of the heating element 1122 in the first direction. The first portion 1122A extends in the first direction.

The second portion 1122B is located adjacent to a one-side end of the first portion 1122A in the first direction. The second portion 1122B is located, in the first direction, at a portion of the heating element 1122 including the one-side end E21. The second portion 1122B has a widthwise dimension larger than a widthwise dimension of the first portion 1122A. In other words, the second portion 1122B has a cross-sectional area larger than a cross-sectional area of the first portion 1122A. Thus, the second portion 1122B has a resistance value per unit length lower than a resistance value per unit length of the first portion 1122A. Thus, the amount of heat generated at the second portion 1122B is smaller than the amount of heat generated at the first portion 1122A.

The third portion 1122C is located adjacent to an other-side end of the first portion 1122A in the first direction. The third portion 1122C is located, in the first direction, at a portion of the heating element 1122 including the other-side end E22. The third portion 1122C has a widthwise dimension larger than the widthwise dimension of the first portion 1122A. In other words, the third portion 1122C has a cross-sectional area larger than the cross-sectional area of the first portion 1122A. Thus, the third portion 1122C has a resistance value per unit length lower than the resistance value per unit length of the first portion 1122A. Thus, the amount of heat generated at the third portion 1122C is smaller than the amount of heat generated at the first portion 1122A.

2.1.2.3 Terminals 1123

The terminals 1123 are disposed between the one-side end E1 of the heater 112 and the heating element 1122 in the first direction. The terminals 1123 are spaced apart from the heating element 1122 in the first direction. Each terminal 1123 is for supplying an electric current to the heating element 1122 and is connected to a power source in the body housing 2 via a connector not illustrated.

2.1.2.4 Wires 1124

The wires 1124 are disposed between the terminals 1123 and the heating element 1122 in the first direction. Each wire 1124 has a one-side end connected to a corresponding one of the terminals 1123 and has an other-side end connected to the heating element 1122. Each wire 1124 is formed of silver or the like. Each wire 1124 electrically connects the corresponding terminal 1123 and the heating element 1122. In other words, the terminal 1123 is electrically connected to the heating element 1122 via the wire 1124.

2.1.3 Holder 113

As illustrated in FIG. 2, the holder 113 supports the heater 112. The holder 113 is disposed on an inner side of the belt 111. The holder 113 extends in the first direction and is formed of a resin or the like. The holder 113 includes a support portion 1131 and two belt guides 1132A, 1132B.

2.1.3.1 Support Portion 1131

The support portion 1131 supports the heater 112 and the heat-conductive member 114. The support portion 1131 is located at a middle portion of the holder 113 in a width direction of the heater 112. The width direction of the heater 112 intersects the first direction and a thickness direction of the heater 112. Preferably, the width direction of the heater 112 is orthogonal to the first direction and orthogonal to the thickness direction of the heater 112. The support portion 1131 is located between the belt guide 1132A and the belt guide 1132B in the width direction of the heater 112. The support portion 1131 includes a support surface 1131A and side surfaces 1131B, 1131C.

The support surface 1131A is located opposite to the pressure roller 12 with respect to the heater 112 in the thickness direction of the heater 112. The support surface 1131A supports the heater 112 and the heat-conductive member 114. The support surface 1131A extends in the width direction of the heater 112 and in the first direction.

The side surface 1131B is located at a one-side end of the support portion 1131 in the width direction of the heater 112. The side surface 1131B is opposed to one of opposite edges, i.e., an edge E11, of the heater 112 in the width direction of the heater 112. The side surface 1131B extends in the thickness direction of the heater 112 and in the first direction.

The side surface 1131C is located at an other-side end of the support portion 1131 in the width direction of the heater 112. The side surface 1131C is spaced apart from the side surface 1131B in the width direction of the heater 112. The side surface 1131C is located opposite to the side surface 1131B with respect to the heater 112 in the width direction of the heater 112. The side surface 1131C is opposed to the other of the opposite edges, i.e., an edge E12, of the heater 112 in the width direction of the heater 112. The side surface 1131C extends in the thickness direction of the heater 112 and in the first direction.

2.1.3.2 Belt Guides 1132A, 1132B

The belt guide 1132A is located at a one-side end of the holder 113 in the width direction of the heater 112. The belt guide 1132A is in contact with the inner circumferential surface S1 of the belt 111. The belt guide 1132A guides rotation of the belt 111.

The belt guide 1132B is located at an other-side end of the holder 113 in the width direction of the heater 112. The belt guide 1132B is located opposite to the belt guide 1132A with respect to the heater 112 in the width direction of the heater 112. The belt guide 1132B is in contact with the inner circumferential surface S1 of the belt 111. The belt guide 1132B guides rotation of the belt 111.

2.1.4 Heat-Conductive Member 114

The heat-conductive member 114 is configured to transmit heat generated by the heater 112 in the first direction. The heat-conductive member 114 is disposed between the heater 112 and the holder 113. Specifically, the heat-conductive member 114 is disposed between a back surface of the heater 112 and the support surface 1131A of the holder 113. The heat-conductive member 114 has a heat conductivity higher than a heat conductivity of the base plate 1121 (FIG. 3) of the heater 112. The heat-conductive member 114 is formed of a metal such as aluminum.

As illustrated in FIG. 3, the heat-conductive member 114 extends in the first direction. The heat-conductive member 114 extends from a position between the terminals 1123 and the heating element 1122 to the other-side end E2 of the heater 112 in the first direction. The heat-conductive member 114 has a one-side end E31 located between the terminals 1123 and the heating element 1122 in the first direction and an other-side end E32 located in the vicinity of the other-side end E2 of the heater 112 in the first direction.

The heat-conductive member 114 includes a contact portion 1141 as one example of a main portion, a first non-contact portion 1142A as one example of a first side portion, a second non-contact portion 1142B as one example of a second side portion, a second contact portion 1143A, and a third contact portion 1143B.

2.1.4.1 Contact Portion 1141

Figure 4:
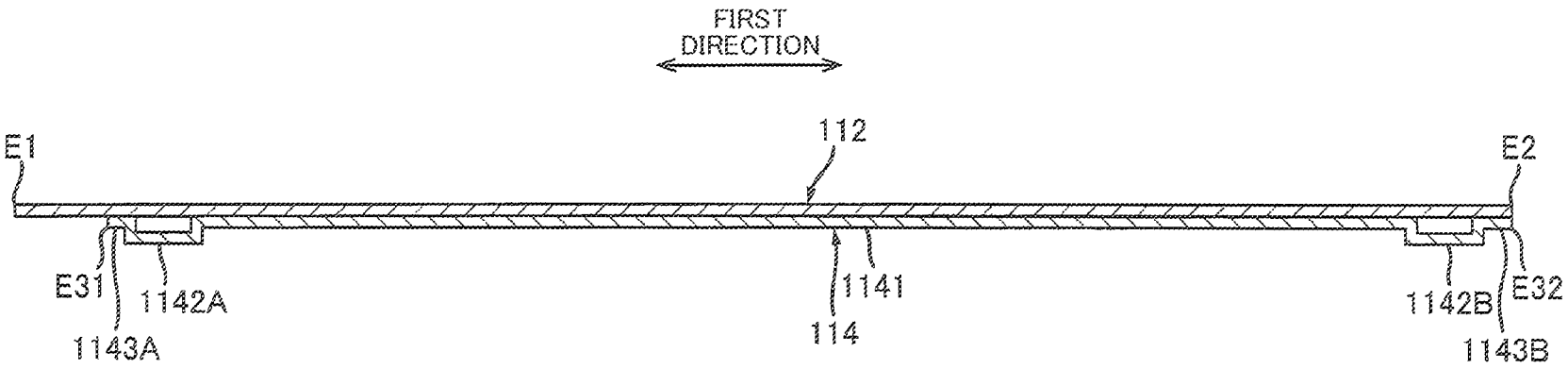
FIG. 4 is an explanatory view illustrating a contacted state of the heater and the heat-conductive member.

The contact portion 1141 is a middle portion of the heat-conductive member 114 in the first direction. The contact portion 1141 is located between the one-side end E21 of the heating element 1122 and the other-side end E22 of the heating element 1122 in the first direction. The contact portion 1141 extends in the first direction. As illustrated in FIG. 4, the contact portion 1141 is in contact with the heater 112.

2.1.4.2 First Non-Contact Portion 1142A

The first non-contact portion 1142A is located between the one-side end E31 of the heat-conductive member 114 and the contact portion 1141 in the first direction. The first non-contact portion 1142A is located between the contact portion 1141 and the second contact portion 1143A in the first direction.

As illustrated in FIG. 4, the first non-contact portion 1142A is not in contact with the heater 112. The first non-contact portion 1142A is opposed to the base plate 1121 of the heater 112 with a gap interposed therebetween in the thickness direction of the heater 112. Thus, heat conduction between the first non-contact portion 1142A and the heater 112 is smaller than heat conduction between the contact portion 1141 and the heater 112.

As illustrated in FIG. 3, the first non-contact portion 1142A extends in the first direction. The first non-contact portion 1142A includes an outer end E41 and an inner end E42 in the first direction. The outer end E41 is one of opposite ends of the first non-contact portion 1142A that is located remote from the contact portion 1141. The outer end E41 is located distant from the contact portion 1141 in the first direction. The inner end E42 is the other of the opposite ends of the first non-contact portion 1142A that is located adjacent to the contact portion 1141. The inner end E42 is located between the outer end E41 and the contact portion 1141 in the first direction.

In the following explanation, one side of a certain position in a certain constituent element that is remote from the center of the fixing device in the first direction is defined as an "outer side" of the position and another side of the certain position in the element that is closer to the center of the fixing device in the first direction is defined as an "inner side" of the position. The first non-contact portion 1142A is opposed to a region of the base plate 1121 in which the one-side end E21 of the heating element 1122 is located. The thus configured first non-contact portion 1142A prevents or reduces transmission of heat of the heater 112 to the outer side of the one-side end E21 of the heating element 1122, thus preventing or reducing a decrease in the fixing temperature in the vicinity of the one-side end E21 of the heating element 1122. The inner end E42 of the first non-contact portion 1142A is located in the maximum-size-sheet passing region A in the first direction. The thus configured first non-contact portion 1142A effectively prevents or reduces transmission of heat of the heater 112 to the outer side of the one-side end portion of the maximum-size-sheet passing region A, thus effectively preventing or reducing a decrease in the fixing temperature at the one-side end portion of the maximum-size-sheet passing region A. The inner end E42 of the first non-contact portion 1142A is opposed to the one-side end of the first portion 1122A of the heating element 1122. In other words, the inner end E42 of the first non-contact portion 1142A is not opposed to a middle portion of the first portion 1122A of the heating element 1122, whereby the first non-contact portion 1142A does not inhibit conduction of heat from the first portion 1122A of the heating element 1122. This configuration enables the fixing temperature to be uniform in the maximum-size-sheet passing region A in the first direction.

The outer end E41 of the first non-contact portion 1142A is located between the terminals 1123 and the heating element 1122 in the first direction. The outer end E41 of the first non-contact portion 1142A is located on the outer side of the one-side end portion of the maximum-size-sheet passing region A in the first direction.

2.1.4.3 Second Non-Contact Portion 1142B

The second non-contact portion 1142B is located between the other-side end E32 of the heat-conductive member 114 and the contact portion 1141 in the first direction. The second non-contact portion 1142B is located between the contact portion 1141 and the third contact portion 1143B in the first direction.

As illustrated in FIG. 4, the second non-contact portion 1142B is not in contact with the heater 112. The second non-contact portion 1142B is opposed to the base plate 1121 of the heater 112 with a gap interposed therebetween in the thickness direction of the heater 112. Thus, heat conduction between the second non-contact portion 1142B and the heater 112 is smaller than heat conduction between the contact portion 1141 and the heater 112.

As illustrated in FIG. 3, the second non-contact portion 1142B extends in the first direction. The second non-contact portion 1142B includes an outer end E51 and an inner end E52 in the first direction. The outer end E51 is one of opposite ends of the second non-contact portion 1142B that is located remote from the contact portion 1141. The outer end E51 is located distant from the contact portion 1141 in the first direction. The inner end E52 is the other of the opposite ends of the second non-contact portion 1142B that is located adjacent to the contact portion 1141. The inner end E52 is located between the outer end E51 and the contact portion 1141 in the first direction.

The second non-contact portion 1142B is opposed to a region of the base plate 1121 in which the other-side end E22 of the heating element 1122 is located. The thus configured second non-contact portion 1142B prevents or reduces transmission of heat of the heater 112 to the outer side of the other-side end E22 of the heating element 1122, thus preventing or reducing a decrease in the fixing temperature in the vicinity of the other-side end E22 of the heating element 1122. The inner end E52 of the second non-contact portion 1142B is located in the maximum-size-sheet passing region A in the first direction. The thus configured second non-contact portion 1142B effectively prevents or reduces transmission of heat of the heater 112 to the outer side of the other-side end portion of the maximum-size-sheet passing region A, thus effectively preventing or reducing a decrease in the fixing temperature at the other-side end portion of the maximum-size-sheet passing region A. The inner end E52 of the second non-contact portion 1142B is opposed to the other-side end of the first portion 1122A in the heating element 1122. In other words, the inner end E52 of the second non-contact portion 1142B is not opposed to the middle portion of the first portion 1122A of the heating element 1122, whereby the second non-contact portion 1142B does not inhibit conduction of heat from the first portion 1122A of the heating element 1122. This configuration enables the fixing temperature to be uniform in the maximum-size-sheet passing region A in the first direction.

The outer end E51 of the second non-contact portion 1142B is located between the other-side end E2 of the heater 112 and the heating element 1122 in the first direction. The outer end E51 of the second non-contact portion 1142B is located on the outer side of the other-side end portion of the maximum-size-sheet passing region A in the first direction.

2.1.4.4 Second Contact Portion 1143A

As illustrated in FIG. 4, the second contact portion 1143A is located at a portion of the heat-conductive member 114 including the one-side end E31 in the first direction. The second contact portion 1143A is in contact with the heater 112. The second contact portion 1143A is located on the outer side of the one-side end portion of the maximum-size-sheet passing region A in the first direction. During printing, the sheet S does not pass the outer side of the one-side end portion of the maximum-size-sheet passing region A. In a case where the image forming device 1 successively performs printing on the sheets S, a portion of the belt 111 located on the outer side of the one-side end portion of the maximum-size-sheet passing region A is likely to have an elevated temperature due to heat of the heater 112. In the present embodiment, the second contact portion 1143A enables heat of the heater 112 on the outer side of the one-side end portion of the maximum-size-sheet passing region A to be conducted to the inner side in the first direction, thus preventing the temperature of the portion of the belt 111 located in a region through which the sheet S does not pass, from becoming high.

2.1.4.5 Third Contact Portion 1143B

The third contact portion 1143B is located at a portion of the heat-conductive member 114 including the other-side end E32 in the first direction. The third contact portion 1143B is in contact with the heater 112. The third contact portion 1143B is located on the outer side of the other-side end portion of the maximum-size-sheet passing region A in the first direction. During printing, the sheet S does not pass the outer side of the other-side end portion of the maximum-size-sheet passing region A. In a case where the image forming device 1 successively performs printing on the sheets S, a portion of the belt 111 located on the outer side of the other-side end portion of the maximum-size-sheet passing region A is likely to have an elevated temperature due to heat of the heater 112. In the present embodiment, the third contact portion 1143B enables heat of the heater 112 on the outer side of the other-side end portion of the maximum-size-sheet passing region A to be conducted to the inner side in the first direction, thus preventing the temperature of the portion of the belt 111 located in a region through which the sheet S does not pass, from becoming high.

2.2 Pressure Roller

As illustrated in FIG. 2, the pressure roller 12 is in contact with the outer circumferential surface S2 of the belt 111. The belt 111 is sandwiched by and between the pressure roller 12 and the heater 112 so that a nip portion is formed to heat and pressurize the sheet S on which the toner has been transferred.

3. Advantageous Effects of First Embodiment (1) In the fixing device 9 according to the first embodiment, the first non-contact portion 1142A and the second non-contact portion 1142B of the heat-conductive member 114 are not in contact with the heater 112, as illustrated in FIG. 4.

In the thus configured heat-conductive member 114, heat conduction between the first non-contact portion 1142A and the heater 112 and heat conduction between the second non-contact portion 1142B and the heater 112 are smaller than heat conduction between the contact portion 1141 and the heater 112.

As illustrated in FIG. 3, the first non-contact portion 1142A of the heat-conductive member 114 is opposed to the one-side end E21 of the heating element 1122, and the second non-contact portion 1142B of the heat-conductive member 114 is opposed to the other-side end E22 of the heating element 1122.

Thus, the first non-contact portion 1142A prevents or reduces transmission of heat of the heater 112 to the outer side of the one-side end E21 of the heating element 1122, and the second non-contact portion 1142B prevents or reduces transmission of heat of the heater 112 to the outer side of the other-side end E22 of the heating element 1122.

This configuration prevents or reduces a decrease in the fixing temperature in the vicinity of the one-side end E21 of the heating element 1122 and in the vicinity of the other-side end E22 of the heating element 1122.

It is consequently possible to prevent or reduce a decrease in the fixing temperature at the one-side end portion and the other-side end portion of the maximum-size-sheet passing region A.

(2) In the fixing device 9 according to the first embodiment, each of the first non-contact portion 1142A and the second non-contact portion 1142B is opposed to the base plate 1121 with a gap interposed therebetween, as illustrated in FIG. 4.

Thus, the first non-contact portion 1142A and the second non-contact portion 1142B of the heat-conductive member 114 are not in contact with the heater 112 owing to the gap described above.

(3) In the fixing device 9 according to the first embodiment, the inner end E42 of the first non-contact portion 1142A and the inner end E52 of the second non-contact portion 1142B are both located, in the first direction, in the region A over which the maximum-size sheet passes, the maximum-size sheet being a sheet having a maximum size among sheets printable in the image forming device 1, i.e., the maximum-size-sheet passing region A, as illustrated in FIG. 3.

The first non-contact portion 1142A configured as described above effectively prevents or reduces transmission of heat of the heater 112 to the outer side of the one-side end portion of the maximum-size-sheet passing region A.

The second non-contact portion 1142B configured as described above effectively prevents or reduces transmission of heat of the heater 112 to the outer side of the other-side end portion of the maximum-size-sheet passing region A.

It is consequently possible to effectively prevent or reduce a decrease in the fixing temperature at the one-side end portion and the other-side end portion of the maximum-size-sheet passing region A.

(4) In the fixing device 9 according to the first embodiment, the inner end E42 of the first non-contact portion 1142A is opposed to the one-side end of the first portion 1122A of the heating element 1122, and the inner end E52 of the second non-contact portion 1142B is opposed to the other-side end of the first portion 1122A of the heating element 1122, as illustrated in FIG. 3.

In other words, the inner end E42 of the first non-contact portion 1142A and the inner end E52 of the second non-contact portion 1142B are both not opposed to the middle portion of the first portion 1122A of the heating element 1122.

In this configuration, the first non-contact portion 1142A and the second non-contact portion 1142B do not inhibit conduction of heat from the first portion 1122A of the heating element 1122.

Thus, this configuration enables the fixing temperature to be uniform in the maximum-size-sheet passing region A in the first direction.

(5) In the fixing device 9 according to the first embodiment, the second contact portion 1143A and the third contact portion 1143B are in contact with the heater 112, as illustrated in FIG. 4.

The thus configured second contact portion 1143A and third contact portion 1143B prevent the temperature of the portions of the belt 111 located on the outer side of the one-side end portion and the other-side end portion of the maximum-size-sheet passing region A from becoming high.

4. Modification of First Embodiment

Figure 5:
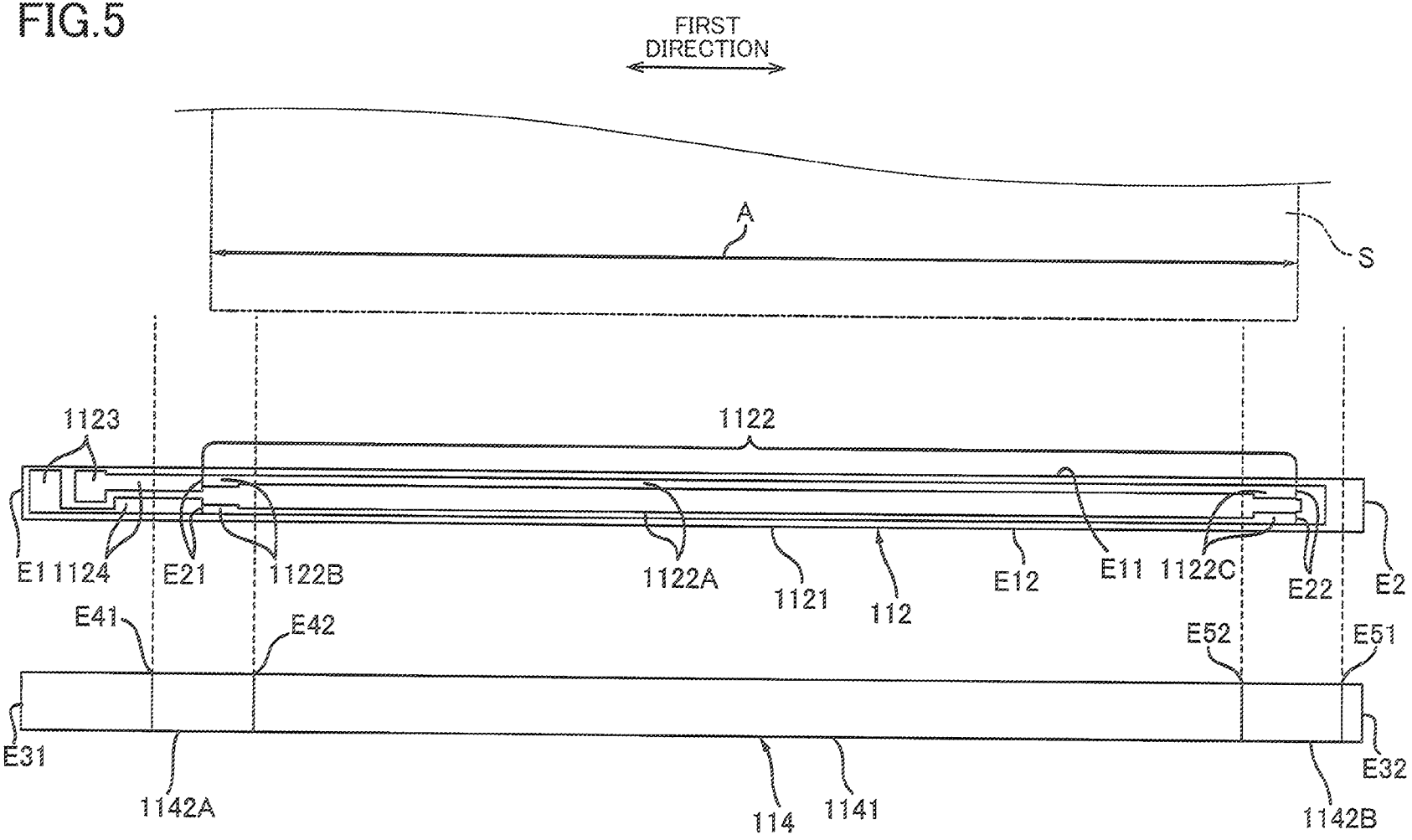
FIG. 5 is an explanatory view illustrating a modification according to the first embodiment.

Referring next to FIG. 5, there will be described a modification of the first embodiment. In this modification, the reference numerals as used in the illustrated first embodiment are used to identify the corresponding components, and a detailed explanation of which is dispensed with.

As illustrated in FIG. 5, the heat-conductive member 114 may extend from the one-side end E1 of the heater 112 to the other-side end E2 of the heater 112 in the first direction.

Second Embodiment

Figure 6:
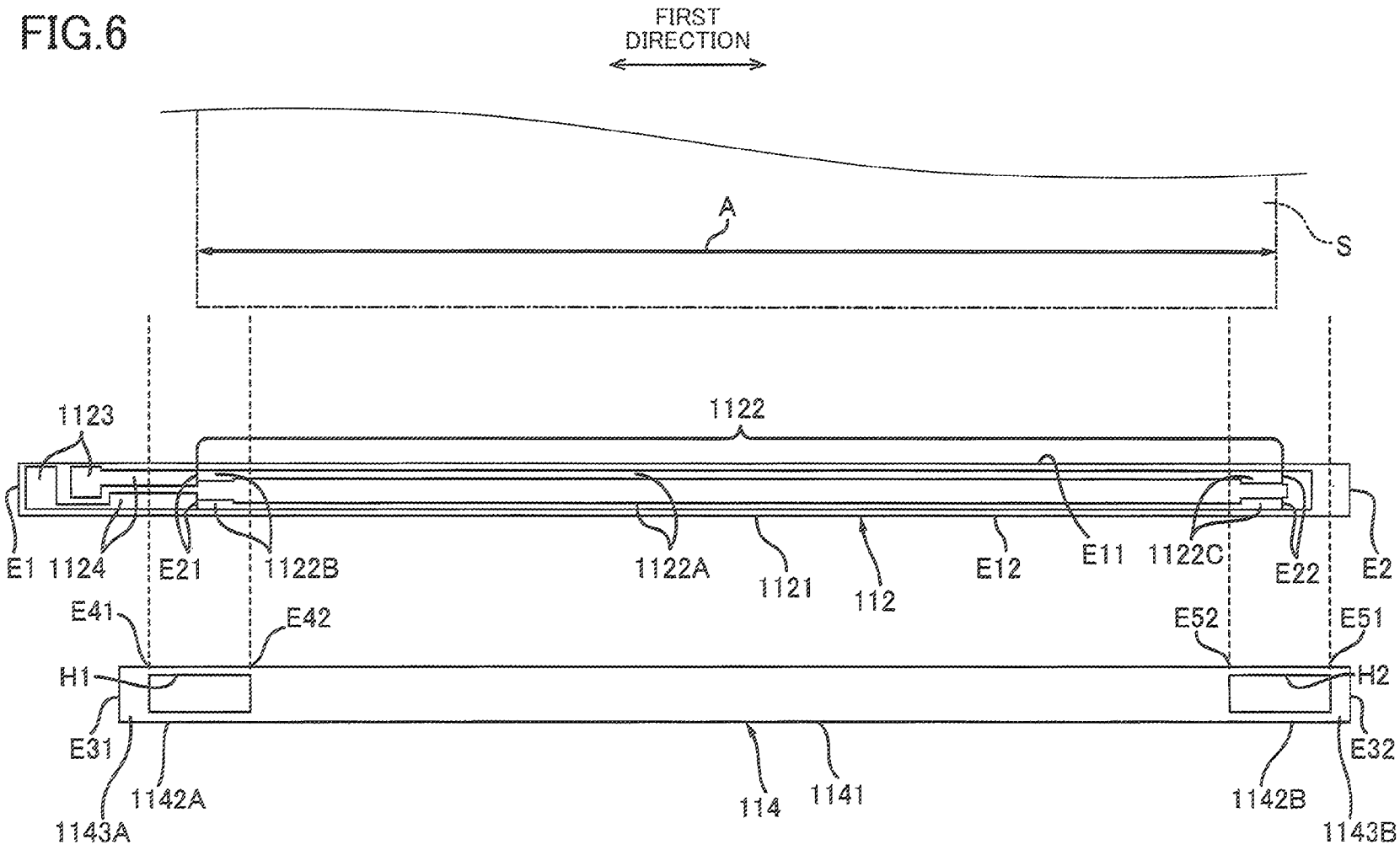
FIG. 6 is an explanatory view illustrating a positional relationship between the heater and a heat-conductive member according to a second embodiment.
Figure 7:
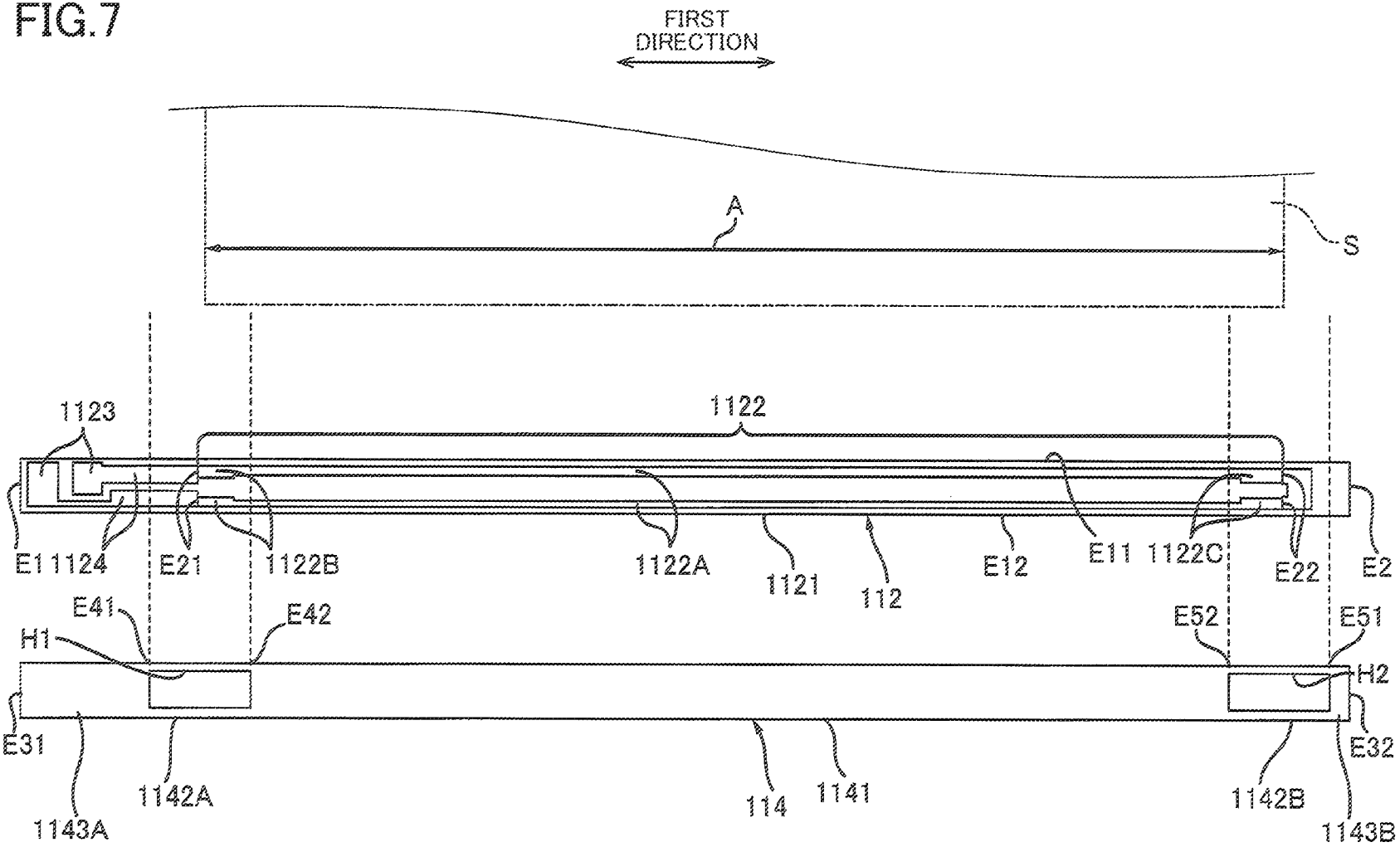
FIG. 7 is an explanatory view illustrating a modification according to the second embodiment.
Figure 8:
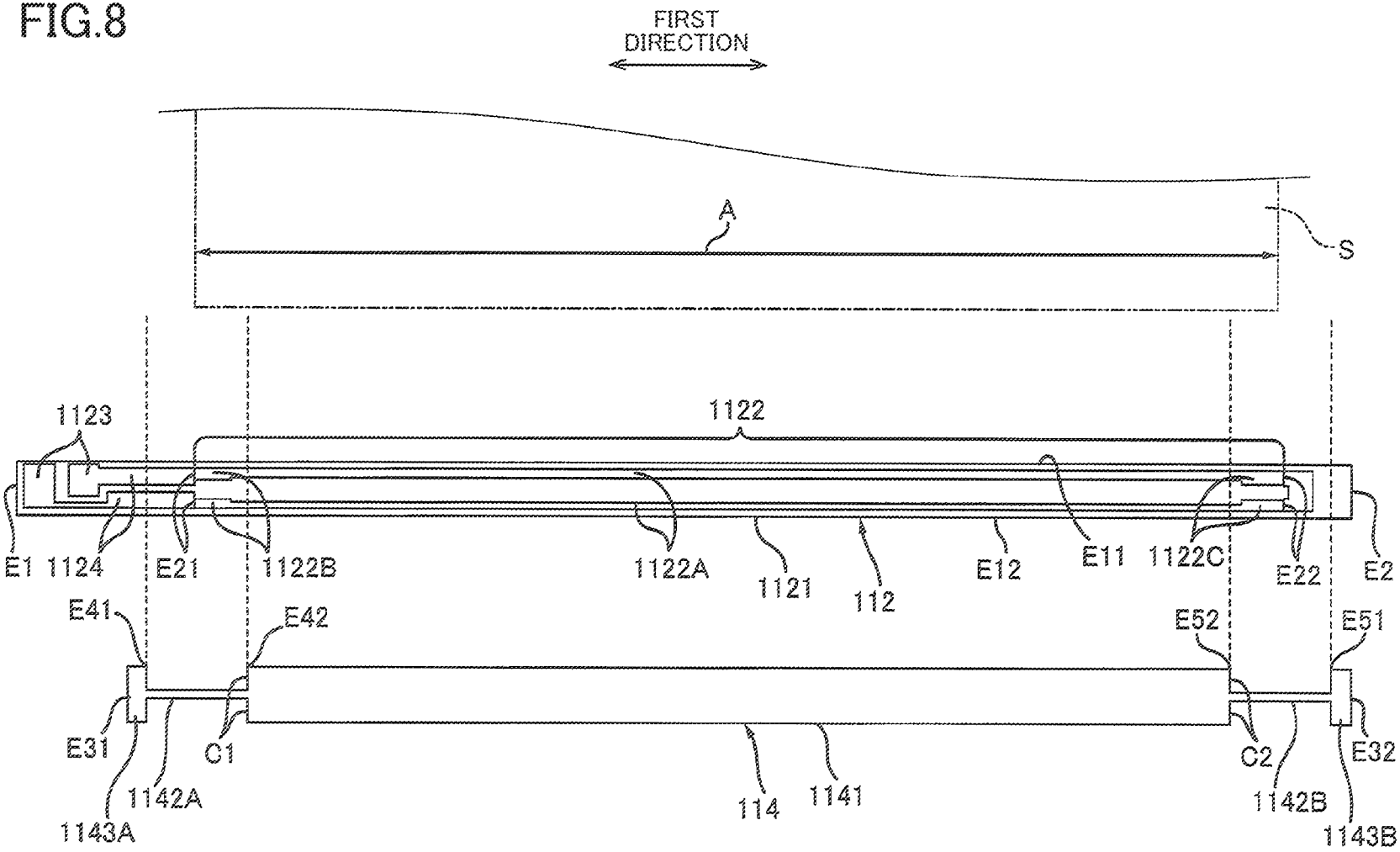
FIG. 8 is an explanatory view illustrating another modification according to the second embodiment.

Referring next to FIGS. 6-8, there will be described a second embodiment according to the present disclosure. The second embodiment differs from the first embodiment in the configuration of the heat-conductive member. Accordingly, the same reference numerals as used in the first embodiment are used to identify the corresponding components, and a detailed explanation of which is dispensed with.

2.1.4. Heat-Conductive Member 114

As illustrated in FIG. 6, the heat-conductive member 114 of the second embodiment includes a main portion 1141, a first opposed portion 1142A as one example of a first side portion, a second opposed portion 1142B as one example of a second side portion, a first end portion 1143A, and a second end portion 1143B.

2.1.4.1 Main Portion 1141

The main portion 1141 is a middle portion of the heat-conductive member 114 in the first direction. The main portion 1141 is located between the one-side end E21 of the heating element 1122 and the other-side end E22 of the heating element 1122 in the first direction. The main portion 1141 is in contact with the heater 112. The main portion 1141 extends in the first direction.

2.1.4.2 First Opposed Portion 1142A

The first opposed portion 1142A is located between the one-side end E31 of the heat-conductive member 114 and the main portion 1141 in the first direction. The first opposed portion 1142A is in contact with the heater 112. In the present embodiment, the first opposed portion 1142A has a rectangular hole H1. Thus, the first opposed portion 1142A has a cross-sectional area smaller than a cross-sectional area of the main portion 1141. In this arrangement, the first opposed portion 1142A is less heat conductive than the main portion 1141.

The first opposed portion 1142A extends in the first direction. The first opposed portion 1142A includes the outer end E41 and the inner end E42 in the first direction. The outer end E41 is one of opposite ends of the first opposed portion 1142A that is located remote from the main portion 1141. The outer end E41 is located distant from the main portion 1141 in the first direction. The inner end E42 is the other of the opposite ends of the first opposed portion 1142A that is located adjacent to the main portion 1141. The inner end E42 is located between the outer end E41 and the main portion 1141 in the first direction.

The first opposed portion 1142A is opposed to a region of the base plate 1121 in which the one-side end E21 of the heating element 1122 is located. The thus configured first opposed portion 1142A prevents or reduces transmission of heat of the heater 112 to the outer side of the one-side end E21 of the heating element 1122, thus preventing or reducing a decrease in the fixing temperature in the vicinity of the one-side end E21 of the heating element 1122. The inner end E42 of the first opposed portion 1142A is located in the maximum-size-sheet passing region A in the first direction. The thus configured first opposed portion 1142A effectively prevents or reduces transmission of heat of the heater 112 to the outer side of the one-side end portion of the maximum-size-sheet passing region A, thus effectively preventing or reducing a decrease in the fixing temperature at the one-side end portion of the maximum-size-sheet passing region A. The inner end E42 of the first opposed portion 1142A is opposed to the one-side end of the first portion 1122A of the heating element 1122. In other words, the inner end E42 of the first opposed portion 1142A is not opposed to the middle portion of the first portion 1122A of the heating element 1122, whereby the first opposed portion 1142A does not inhibit conduction of heat from the first portion 1122A of the heating element 1122. This configuration enables the fixing temperature to be uniform in the maximum-size-sheet passing region A in the first direction.

The outer end E41 of the first opposed portion 1142A is located between the terminals 1123 and the heating element 1122 in the first direction. The outer end E41 of the first opposed portion 1142A is located on the outer side of the one-side end portion of the maximum-size-sheet passing region A in the first direction.

2.1.4.3 Second Opposed Portion 1142B

The second opposed portion 1142B is located between the other-side end E32 of the heat-conductive member 114 and the main portion 1141 in the first direction. The second opposed portion 1142B is in contact with the heater 112. In the present embodiment, the second opposed portion 1142B has a rectangular hole H2. Thus, the second opposed portion 1142B has a cross-sectional area smaller than a cross-sectional area of the main portion 1141. In this arrangement, the second opposed portion 1142B is less heat conductive than the main portion 1141.

The second opposed portion 1142B extends in the first direction. The second opposed portion 1142B includes the outer end E51 and the inner end E52 in the first direction. The outer end E51 is one of opposite ends of the second opposed portion 1142B that is located remote from the main portion 1141. The outer end E51 is located distant from the main portion 1141 in the first direction. The inner end E52 is the other of the opposite ends of the second opposed portion 1142B that is located adjacent to the main portion 1141. The inner end E52 is located between the outer end E51 and the main portion 1141 in the first direction.

The second opposed portion 1142B is opposed to a region of the base plate 1121 in which the other-side end E22 of the heating element 1122 is located. The thus configured second opposed portion 1142B prevents or reduces transmission of heat of the heater 112 to the outer side of the other-side end E22 of the heating element 1122, thus preventing or reducing a decrease in the fixing temperature in the vicinity of the other-side end E22 of the heating element 1122. The inner end E52 of the second opposed portion 1142B is located in the maximum-size-sheet passing region A in the first direction. The thus configured second opposed portion 1142B effectively prevents or reduces transmission of heat of the heater 112 to the outer side of the other-side end portion of the maximum-size-sheet passing region A, thus effectively preventing or reducing a decrease in the fixing temperature at the other-side end portion of the maximum-size-sheet passing region A. The inner end E52 of the second opposed portion 1142B is opposed to the other-side end of the first portion 1122A of the heating element 1122. In other words, the inner end E52 of the second opposed portion 1142B is not opposed to the middle portion of the first portion 1122A of the heating element 1122, whereby the second opposed portion 1142B does not inhibit conduction of heat from the first portion 1122A of the heating element 1122. This configuration enables the fixing temperature to be uniform in the maximum-size-sheet passing region A in the first direction.

The outer end E51 of the second opposed portion 1142B is located between the other-side end E2 of the heater 112 and the heating element 1122 in the first direction. The outer end E51 of the second opposed portion 1142B is located on the outer side of the other-side end portion of the maximum-size-sheet passing region A in the first direction.

2.1.4.4 First End Portion 1143A

The first end portion 1143A is located between the one-side end E31 of the heat-conductive member 114 and the outer end E41 of the first opposed portion 1142A in the first direction. That is, the first end portion 1143A is located on the outer side of the one-side end portion of the maximum-size-sheet passing region A in the first direction. The first end portion 1143A is in contact with the heater 112. In the present embodiment, the first end portion 1143A has the same widthwise dimension as the main portion 1141. Thus, the first end portion 1143A has a cross-sectional area larger than a cross-sectional area of the first opposed portion 1142A. In this arrangement, the first end portion 1143A is more heat conductive than the first opposed portion 1142A. During printing, the sheet S does not pass the outer side of the one-side end portion of the maximum-size-sheet passing region A. In a case where the image forming device 1 successively performs printing on the sheets S, a portion of the belt 111 located on the outer side of the one-side end portion of the maximum-size-sheet passing region A is likely to have an elevated temperature due to heat of the heater 112. In the present embodiment, the first end portion 1143A enables heat of the heater 112 on the outer side of the one-side end portion of the maximum-size-sheet passing region A to be conducted to the inner side in the first direction, thus preventing the temperature of the portion of the belt 111 located in a region through which the sheet S does not pass, from becoming high.

2.1.4.5 Second End Portion 1143B

The second end portion 1143B is located between the other-side end E32 of the heat-conductive member 114 and the outer end E51 of the second opposed portion 1142B in the first direction. That is, the second end portion 1143B is located on the outer side of the other-side end portion of the maximum-size-sheet passing region A in the first direction. The second end portion 1143B is in contact with the heater 112. In the present embodiment, the second end portion 1143B has the same widthwise dimension as the main portion 1141. Thus, the second end portion 1143B has a cross-sectional area larger than a cross-sectional area of the second opposed portion 1142B. In this arrangement, the second end portion 1143B is more heat conductive than the second opposed portion 1142B. During printing, the sheet S does not pass the outer side of the other-side end portion of the maximum-size-sheet passing region A. In a case where the image forming device 1 successively performs printing on the sheets S, a portion of the belt 111 located on the outer side of the other-side end portion of the maximum-size-sheet passing region A is likely to have an elevated temperature due do heat of the heater 112. In the present embodiment, the second end portion 1143B enables heat of the heater 112 on the outer side of the other-side end portion of the maximum-size-sheet passing region A to be conducted in the inner side in the first direction, thus preventing the temperature of the portion of the belt 111 located in a region through which the sheet S does not pass, from becoming high.

3. Advantageous Effects of Second Embodiment (1) In the fixing device 9 according to the second embodiment, the cross-sectional areas of the first opposed portion 1142A and the second opposed portion 1142B of the heat-conductive member 114 are smaller than the cross-sectional area of the main portion 1141 of the heat-conductive member 114, as illustrated in FIG. 6.

In the thus configured heat-conductive member 114, the first opposed portion 1142A and the second opposed portion 1142B are less heat conductive than the main portion 1141.

The first opposed portion 1142A of the heat-conductive member 114 is opposed to the region of the base plate 1121 in which the one-side end E21 of the heating element 1122 is located, and the second opposed portion 1142B of the heat-conductive member 114 is opposed to the region of the base plate 1121 in which the other-side end E22 of the heating element 1122 is located.

Thus, the first opposed portion 1142A prevents or reduces transmission of heat of the heater 112 to the outer side of the one-side end E21 of the heating element 1122, and the second opposed portion 1142B prevents or reduces transmission of heat of the heater 112 to the outer side of the other-side end E22 of the heating element 1122.

This configuration prevents or reduces a decrease in the fixing temperature in the vicinity of the one-side end E21 of the heating element 1122 and in the vicinity of the other-side end E22 of the heating element 1122.

It is consequently possible to prevent or reduce a decrease in the fixing temperature at the one-side end portion and the other-side end portion of the region A over which the maximum-size sheet passes, the maximum-size sheet being a sheet having a maximum size among sheets printable in the image forming device 1, i.e., the maximum-size-sheet passing region A.

(2) In the fixing device 9 according to the second embodiment, the inner end E42 of the first opposed portion 1142A and the inner end E52 of the second opposed portion 1142B are both located in the maximum-size-sheet passing region A in the first direction, as illustrated in FIG. 6.

The first opposed portion 1142A configured as described above effectively prevents or reduces transmission of heat of the heater 112 to the outer side of the one-side end portion of the maximum-size-sheet passing region A.

The second opposed portion 1142B configured as described above effectively prevents or reduces transmission of heat of the heater 112 to the outer side of the other-side end portion of the maximum-size-sheet passing region A.

It is consequently possible to effectively prevent or reduce a decrease in the fixing temperature at the one-side end portion and the other-side end portion of the maximum-size-sheet passing region A.

(3) In the fixing device 9 according to the second embodiment, the inner end E42 of the first opposed portion 1142A is opposed to the one-side end of the first portion 1122A of the heating element 1122, and the inner end E52 of the second opposed portion 1142B is opposed to the other-side end of the first portion 1122A of the heating element 1122, as illustrated in FIG. 6.

In other words, the inner end E42 of the first opposed portion 1142A and the inner end E52 of the second opposed portion 1142B are both not opposed to the first portion 1122A of the heating element 1122.

In this configuration, the first opposed portion 1142A and the second opposed portion 1142B do no inhibit conduction of heat from the first portion 1122A of the heating element 1122.

Thus, this configuration enables the fixing temperature to be uniform in the maximum-size-sheet passing region A in the first direction.

4. Modifications of Second Embodiment

Referring next to FIGS. 7 and 8, there will be described modifications of the second embodiment. In the modifications, the reference numerals as used in the illustrated second embodiment are used to identify the corresponding components, and a detailed explanation of which is dispensed with.

(1) As illustrated in FIG. 7, the heat-conductive member 114 may extend from the one-side end E1 of the heater 112 to the other-side end E2 of the heater 112 in the first direction.

(2) As illustrated in FIG. 8, the first opposed portion 1142A of the heat-conductive member 114 may have a cutout C1 in place of the hole H1 (FIG. 3), and the second opposed portion 1142B of the heat-conductive member 114 may have a cutout C2 in place of the hole H2 (FIG. 3).

The first opposed portion 1142A of the heat-conductive member 114 may have a cutout C1 while the second opposed portion 1142B of the heat-conductive member 114 may have the hole H2. The first opposed portion 1142A of the heat-conductive member 114 may have the hole H1 while the second opposed portion 1142B of the heat-conductive member 114 may have a cutout C2.

What is claimed is:

1. A fixing device, comprising:

a cylindrical belt;

a heater to heat the belt, the heater including (a) a base plate and (b) a heating element provided on the base plate, the heating element having a one-side end and an other-side end in a first direction;

a holder supporting the heater; and a heat-conductive member disposed between the heater and the holder, the heat-conductive member having a heat conductivity higher than a heat conductivity of the base plate, wherein the heat-conductive member includes:

a contact portion that is opposed to a region of the base plate between the one-side end of the heating element and the other-side end of the heating element in the first direction, the contact portion being in contact with the heater;

a first non-contact portion that is opposed to a region of the base plate in which the one-side end of the heating element is located, the first non-contact portion being not in contact with the heater, and a second non-contact portion that is opposed to a region of the base plate in which the other-side end of the heating element is located, the second non-contact portion being not in contact with the heater.

2. The fixing device according to claim 1, wherein each of the first non-contact portion and the second non-contact portion is opposed to the base plate with a gap interposed therebetween.

3. The fixing device according to claim 1, wherein an end of the first non-contact portion located adjacent to the contact portion and an end of the second non-contact portion located adjacent to the contact portion are both located, in the first direction, in a region (A) over which a maximum-size sheet passes, the maximum-size sheet being a sheet having a maximum size among sheets fixable in the fixing device.

4. The fixing device according to claim 1, wherein the heating element includes:

a first portion that is a middle portion of the heating element in the first direction;

a second portion located adjacent to a one-side end of the first portion in the first direction and having a resistance value per unit length lower than a resistance value per unit length of the first portion; and a third portion located adjacent to an other-side end of the first portion in the first direction and having a resistance value per unit length lower than the resistance value per unit length of the first portion, wherein an end of the first non-contact portion located adjacent to the contact portion is opposed to the one-side end of the first portion of the heating element, and wherein an end of the second non-contact portion located adjacent to the contact portion is opposed to the other-side end of the first portion of the heating element.

5. The fixing device according to claim 1, wherein the heater further includes a terminal disposed between a one-side end of the heater and the heating element in the first direction and connected electrically to the heating element via a wire, and wherein the heat-conductive element extends, in the first direction, from a position between the terminal and the heating element to an other-side end of the heater.

6. The fixing device according to claim 1, wherein the heat-conductive member extends, in the first direction from a one-side end of the heater to an other-side end of the heater.

7. The fixing device according to claim 1, wherein the heat-conductive member includes:

a second contact portion that is located at a portion of the heat-conductive member including a one-side end thereof in the first direction and that is in contact with the heater; and a third contact portion that is located at a portion of the heat-conductive member including an other-side end thereof in the first direction and that is in contact with the heater, wherein the first non-contact portion is located between the contact portion and the second contact portion in the first direction, and wherein the second non-contact portion is located between the contact portion and the third contact portion in the first direction.

8. A fixing device, comprising:

a cylindrical belt;

a heater to heat the belt, the heater including (a) a base plate and (b) a heating element provided on the base plate, the heating element having a one-side end and an other-side end in a first direction;

a holder supporting the heater; and a heat-conductive member disposed between the heater and the holder, the heat-conductive member having a heat conductivity higher than a heat conductivity of the base plate, wherein the heat-conductive member includes:

a main portion that is opposed to a region of the base plate between the one-side end of the heating element and the other-side end of the heating element in the first direction;

a first opposed portion that is opposed to a region of the base plate in which the one-side end of the heating element is located, and a second opposed portion that is opposed to a region of the base plate in which the other-side end of the heating element is located, and wherein each of a cross-sectional area of the first opposed portion and a cross-sectional area of the second opposed portion is smaller than a cross-sectional area of the main portion, each of the cross-sectional areas being an area of a cross section orthogonal to the first direction.

9. The fixing device according to claim 8, wherein an end of the first opposed portion located adjacent to the main portion and an end of the second opposed portion located adjacent to the main portion are both located, in the first direction, in a region (A) over which a maximum-size sheet passes, the maximum-size sheet being a sheet having a maximum size among sheets fixable in the fixing device.

10. The fixing device according to claim 8, wherein the heating element includes:

a first portion that is a middle portion of the heating element in the first direction;

a second portion located adjacent to a one-side end of the first portion in the first direction and having a resistance value per unit length lower than a resistance value per unit length of the first portion; and a third portion located adjacent to an other-side end of the first portion in the first direction and having a resistance value per unit length lower than the resistance value per unit length of the first portion, wherein an end of the first opposed portion located adjacent to the main portion is opposed to the one-side end of the first portion of the heating element, and wherein an end of the second opposed portion located adjacent to the main portion is opposed to the other-side end of the first portion of the heating element.

11. The fixing device according to claim 8, wherein the heat-conductive member includes:

a first end portion located between a one-side end of the heat-conductive member in the first direction and an end of the first opposed portion located remote from the main portion, the first end portion having a cross-sectional area larger than a cross-sectional area of the first opposed portion, and a second end portion located between an other-side end of the heat-conductive member in the first direction and an end of the second opposed portion located remote from the main portion, the second end portion having a cross-sectional area larger than a cross-sectional area of the second opposed portion.

12. The fixing device according to claim 8, wherein the heater further includes a terminal disposed between a one-side end of the heater and the heating element in the first direction and connected electrically to the heating element via a wire, and wherein the heat-conductive element extends, in the first direction, from a position between the terminal and the heating element to an other-side end of the heater.

13. The fixing device according to claim 8, wherein the heat-conductive member extends, in the first direction from a one-side end of the heater to an other-side end of the heater.

14. The fixing device according to claim 8, wherein each of the first opposed portion and the second opposed portion has a rectangular hole.

15. The fixing device according to claim 8, wherein at least one of the first opposed portion and the second opposed portion has a cutout.

* * * * *